US011554078B2

(12) United States Patent
Zack et al.

(10) Patent No.: US 11,554,078 B2
(45) Date of Patent: Jan. 17, 2023

(54) MODULAR SAUNA HEATER AND METHOD FOR CONSTRUCTING A SAUNA

(71) Applicant: Sunlighten, Inc., Overland Park, KS (US)

(72) Inventors: Aaron Michael Zack, Overland Park, KS (US); Jonathon Kemnitzer, Overland Park, KS (US); Dustin Stevens, Overland Park, KS (US)

(73) Assignee: Sunlighten, Inc., Overland Park, KS (US)

( * ) Notice: Subject to any disclaimer, the term of this patent is extended or adjusted under 35 U.S.C. 154(b) by 138 days.

(21) Appl. No.: 17/096,619

(22) Filed: Nov. 12, 2020

(65) Prior Publication Data

US 2021/0137781 A1 May 13, 2021

Related U.S. Application Data

(60) Provisional application No. 62/934,665, filed on Nov. 13, 2019.

(51) Int. Cl.
*A61H 33/06* (2006.01)

(52) U.S. Cl.
CPC ..... *A61H 33/063* (2013.01); *A61H 33/066* (2013.01); *A61H 2033/061* (2013.01); *A61H 2201/0207* (2013.01); *A61H 2201/0221* (2013.01)

(58) Field of Classification Search
CPC ..... A61H 33/063
USPC ..... 4/524, 535; 126/350.2; 607/1, 81–83
See application file for complete search history.

(56) References Cited

U.S. PATENT DOCUMENTS 3,275,800 A * 9/1966 Kuoppamaki ..... A61H 33/063 219/486
3,348,021 A * 10/1967 Skogland ..... A61H 33/063 392/394
3,361,895 A * 1/1968 Achner ..... A61H 33/06 607/81

(Continued)

FOREIGN PATENT DOCUMENTS

GB 2195530 A * 4/1988 ..... A61H 33/06
KR 100767753 B1 10/2007
WO 9635316 11/1996

OTHER PUBLICATIONS

Heating Green, SolaRay Yoga Heater, website, https://heatinggreen.com/ducoterra-yoga-heater/.

(Continued)

*Primary Examiner* — Lori L Baker
(74) *Attorney, Agent, or Firm* — AVEK IP, LLC; Kent R. Erickson

(57) ABSTRACT

Modular infrared heater units for a sauna and methods for constructing a sauna. The infrared heater units include one or more heating elements disposed in a housing. The housing is configured for direct mounting on walls of a structure and includes a pigtail for coupling to a controller. The housing is dimensioned to accommodate a paneling or other cladding on the walls and includes a trim frame that obscures edges of the cladding adjacent to the heater unit. Construction of a sauna unit includes mounting of a plurality of the heater units on walls of the structure; electrically communicably coupling the heater units to a controller; and providing any desired cladding to the interior of the structure.

23 Claims, 13 Drawing Sheets

(56) References Cited

U.S. PATENT DOCUMENTS

| | | | | |
|---|---|---|---|---|
| 3,422,465 | A * | 1/1969 | Jones | A61H 33/06 392/360 |
| 3,452,369 | A * | 7/1969 | Jones | A61H 33/06 219/400 |
| 3,564,201 | A * | 2/1971 | Jones | A61H 33/06 392/374 |
| 5,987,662 | A * | 11/1999 | Kiyokawa | A61H 33/063 4/524 |
| 6,327,720 | B1 * | 12/2001 | Kim | A61H 33/06 4/524 |
| 7,559,095 | B2 * | 7/2009 | Tei | G05D 23/19 607/83 |
| 8,737,827 | B2 | 5/2014 | Zack et al. | |
| 2002/0096984 | A1 | 7/2002 | Konishi et al. | |
| 2007/0050903 | A1 * | 3/2007 | Sappenfield | A61H 33/06 4/524 |
| 2007/0294818 | A1 * | 12/2007 | Tei | A61H 33/06 4/524 |
| 2008/0285963 | A1 * | 11/2008 | Hendrikse | A47K 10/48 392/380 |
| 2010/0017953 | A1 * | 1/2010 | O'Keeffe | A61N 5/0625 219/480 |
| 2012/0233764 | A1 * | 9/2012 | Lee | A61H 33/06 4/524 |
| 2014/0157511 | A1 | 6/2014 | Shurtleff | |
| 2014/0345041 | A1 * | 11/2014 | Barghelame | A61H 33/066 4/526 |
| 2015/0040308 | A1 * | 2/2015 | Lee | A61H 33/066 4/524 |
| 2015/0338099 | A1 | 11/2015 | Deng | |
| 2017/0312172 | A1 | 11/2017 | O'Keeffe et al. | |
| 2019/0167519 | A1 | 6/2019 | Kaps et al. | |

OTHER PUBLICATIONS

Compact Appliance, Bromic Heating Platinum 2300 Watt Wall Mounted Electric Heater, website, https://www.compactappliance.com/bromic-heating-heaters-outdoor-living/BH0320007.html?uid=3516626&cawelaid=120310670000064886&gclid=Cj%85.

Infralia, Indoor Infrared Heaters, website, https://www.infralia.com/en/product-category/indoor-infrared-heaters/.

Prestyl Energy Group, Product, website, https://prestylenergygroup.com/product/.

Heating Green, Go-Anywhere Heater, website, https://heatinggreen.com/product/go-anywhere-heater/.

Infrared Sauna Parts, Infrared Sauna Carbon Heaters with Wood Trim 120 Watts (31" x 11")—110V/120V, website, https://infraredsaunaparts.com/infrared-sauna-carbon-heaters-with-wood-trim-120-watts-31-x-11-en.html.

Marley Engineered Products, WorkWarmer Desk Heater, website, https://www.marleymep.com/products/fahrenheat/workwarmer-desk-heater.

Heating Green, All Heating Green Products, website, https://heatinggreen.com/all-heating-green-products/.

Grainger, QMARK Radiant Electric Ceiling Panel Heater 750W 240V AC 1-phase white, website, https://www.grainger.com/product/QMARK-Radiant-54UD28?searchQuery-CP752F&searchBar-true.

* cited by examiner

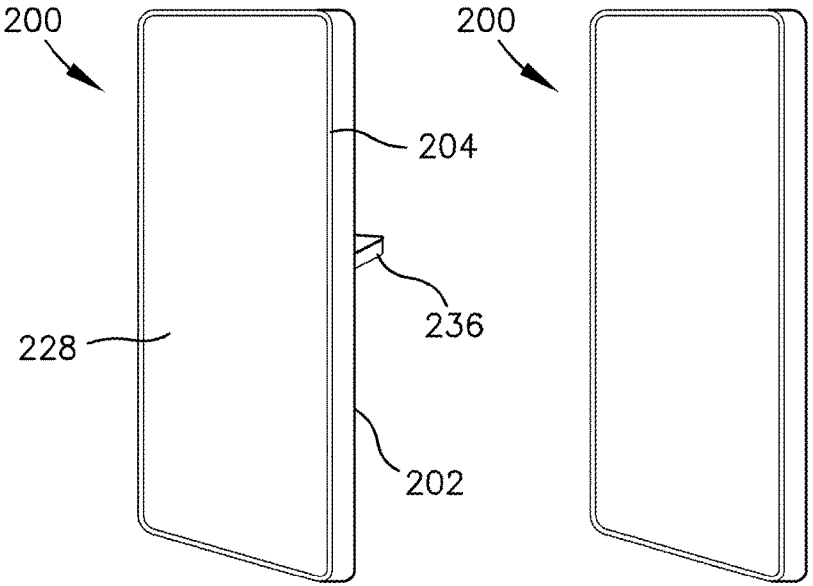
Fig. 24
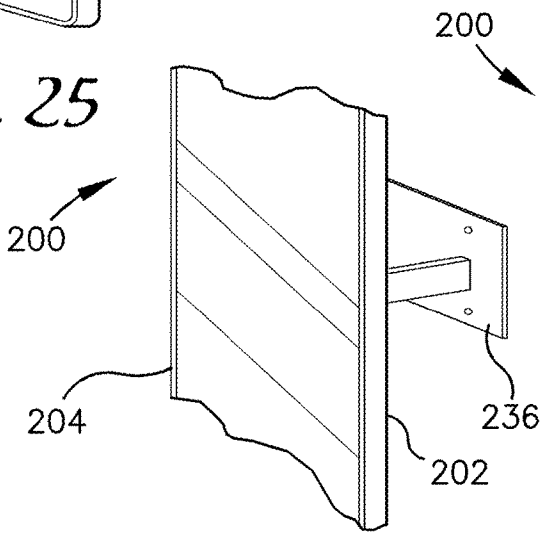
Fig. 25
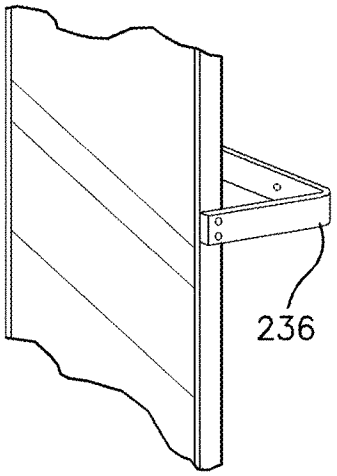
Fig. 26
Fig. 27

MODULAR SAUNA HEATER AND METHOD FOR CONSTRUCTING A SAUNA

CROSS-REFERENCE TO RELATED APPLICATIONS

This application claims the benefit of U.S. Provisional Patent Application No. 62/934,665, filed Nov. 13, 2019 the disclosure of which is hereby incorporated herein in its entirety by reference.

BACKGROUND

The popularity of saunas for treatment of a myriad of conditions is ever increasing. With that comes increased interest in incorporating sauna units into residential dwellings and commercial spaces. One available option is a stand-alone, pre-manufactured sauna unit that can be disposed in an existing location. Another option is an integrated sauna unit that is constructed in and potentially as part of the structure at a location. Yet another option is a stand-alone heating unit that can be disposed in a room or other location to provide sauna-like qualities and/or infrared heating to the room.

Construction of such integrated sauna units can be complex and much more expensive than simply disposing a stand-alone unit in an available space. For example, construction may require access to the internal structures at the location, i.e. access to studs or support members in walls, ceilings, etc. Additionally, certain design characteristics like clearance between insulation in the walls of the structure and heating elements of the sauna must be adhered to for safety. A licensed electrician is also likely required to design and provide connections between the heating units and a controller for the sauna unit as well as between the sauna unit and a power grid of the structure.

SUMMARY

Exemplary embodiments are defined by the claims below, not this summary. A high-level overview of various aspects thereof is provided here to introduce a selection of concepts that are further described in the Detailed-Description section below. This summary is not intended to identify key features or essential features of the claimed subject matter, nor is it intended to be used in isolation to determine the scope of the claimed subject matter. In brief, this disclosure describes infrared heaters for a sauna unit and methods for installing a sauna in a structure.

In one embodiment, infrared heaters for a sauna unit are described. The heaters are configured to generate infrared radiation in one or more of near, mid, and far infrared radiation spectrums using one or more forms of electrical heating element such as planar carbon resistance heaters, LEDs, polyimide heaters, halogen bulbs, or the like. The heating elements are disposed within a housing having a back wall, a perimeter wall extending about the perimeter thereof and an open front face. The housing may be dimensioned and/or provided with features configured for coupling the housing to walls of a structure. For example, the housing may be dimensioned to span between and couple to studs of a structure or may include fastener holes therethrough that align with the studs.

The heating elements are preferably enclosed within the housing by a fabric, metallic, composite, or similar material that is substantially transparent to infrared emissions and that is disposed to extend across and between distal edges of the perimeter wall. For example, the material may comprise a carbonized bamboo fabric that enables infrared radiation produced by the heating elements to pass through while also providing an aesthetically pleasing appearance. The material may also aid to protect a user against contact with the heating elements. A trim piece is coupled to the perimeter wall to cover an edge of the housing and a junction between the material and the housing.

The infrared heater is configured for direct mounting on a wall of a structure, such as on a drywall sheathing commonly used in residential structures. It is common practice to line an interior of a sauna unit with a wood paneling or planks. Accordingly, the perimeter wall of the housing is dimensioned to accommodate a thickness of such a paneling between the wall surface and a backside of the trim piece. The trim piece thus overlaps a gap between the wood paneling and the perimeter wall of the heater unit to provide an aesthetic appearance.

The heater is provided with a communicative coupling means such as a cable or pigtail that that can be directly or indirectly coupled to a controller for the sauna unit. The pigtail is configured to carry all power and data communications necessary to operate the heater and includes a terminal coupler. The terminal coupler is configured to couple to an extension line to provide additional length to the pigtail or to couple directly to a communications bus. The communications bus may be coupled to a plurality of heater units. The communications bus may be integrated with a controller or the controller may be communicably coupled to the bus.

In another embodiment, a method for constructing a sauna unit is provided. A plurality of heater units are mounted at desired locations on a structure. The heater units may be mounted on existing surfaces of a structure, such as for example, on exiting drywall covered walls of an existing room. Or a structure may be newly purpose-built for the sauna unit, in which case the heater units may be mounted directly to studs or other support members of the newly built structure. Pigtails from each of the heater units are coupled to a communications bus to provide electrical communications with a controller. The communications bus and/or the controller is coupled with an electrical grid of the structure using an existing plug and socket like that commonly found in residential and commercial structures for connection to, for example, a source of 120 volt or 240 volt alternating current. Alternatively, a direct wire connection may be employed. A paneling, such as wood paneling or planks may be installed on walls of the structure. The paneling is preferably disposed to abut or to extend into close proximity to the heater units such that the trim piece of the heater units overlies edges of the paneling adjacent to the heater units.

In another embodiment, one or more standalone heaters are provided. The standalone heaters may be self-supporting on a floor surface or may be mounted on a wall or ceiling. The standalone heaters can be employed to provide a sauna-like experience in a room without full construction of an integrated sauna unit. The standalone heaters may also be employed to provide infrared treatments and/or heating of the room.

DESCRIPTION OF THE DRAWINGS

Illustrative embodiments are described in detail below with reference to the attached drawing figures, and wherein:

FIGS. 24-27 are illustrative views of wall-mountable infrared heaters showing mounting configurations therefor depicted in accordance with exemplary embodiments.

DETAILED DESCRIPTION

Figure 2:
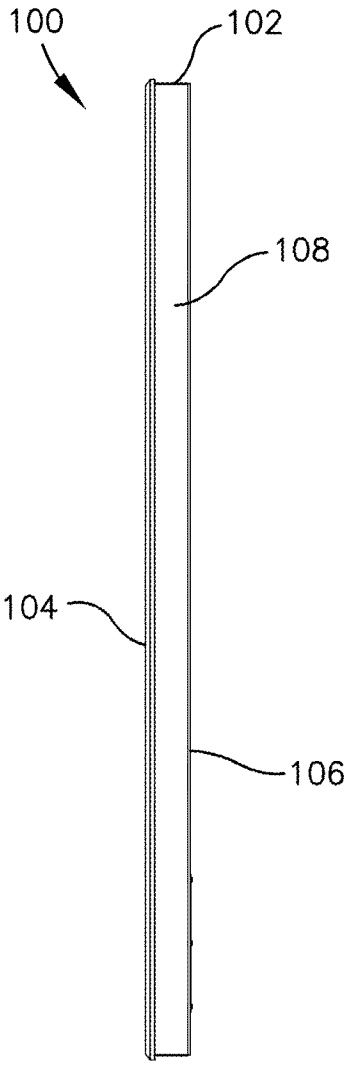
FIG. 2 is a side elevational view of the modular sauna heater of FIG. 1.
Figure 1:
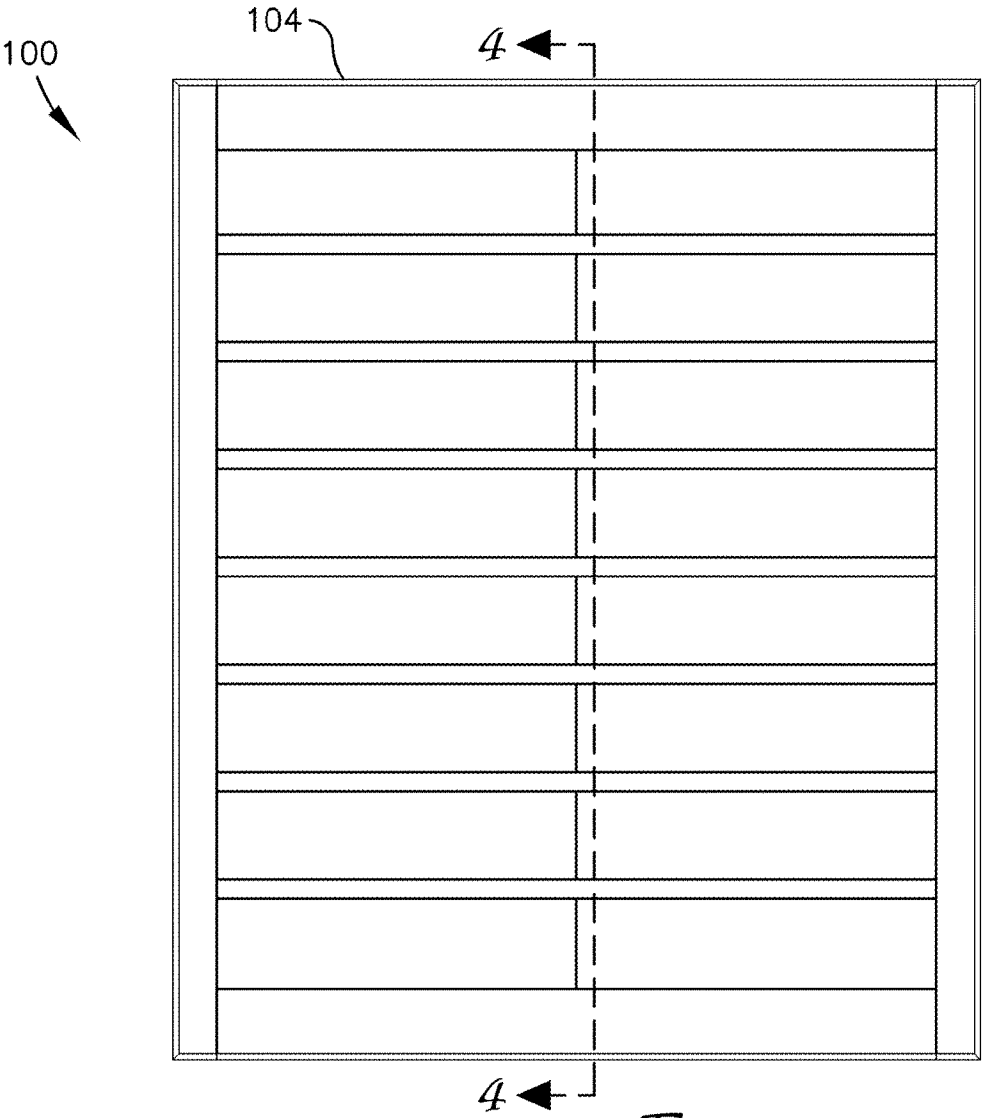
FIG. 1 is a front elevational view of a modular sauna heater depicted in accordance with an exemplary embodiment.
Figure 4:
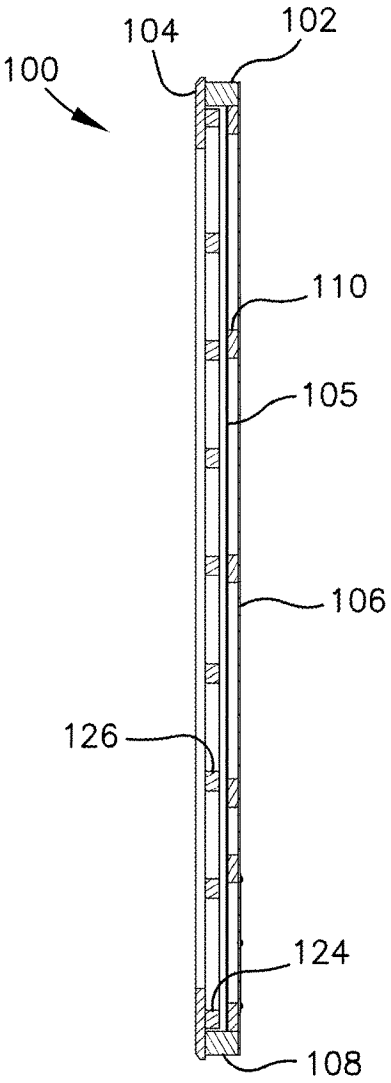
FIG. 4 is a cross-sectional view of the modular sauna heater of FIG. 1 taken along the line 4-4 shown in FIG. 1.
Figure 3:
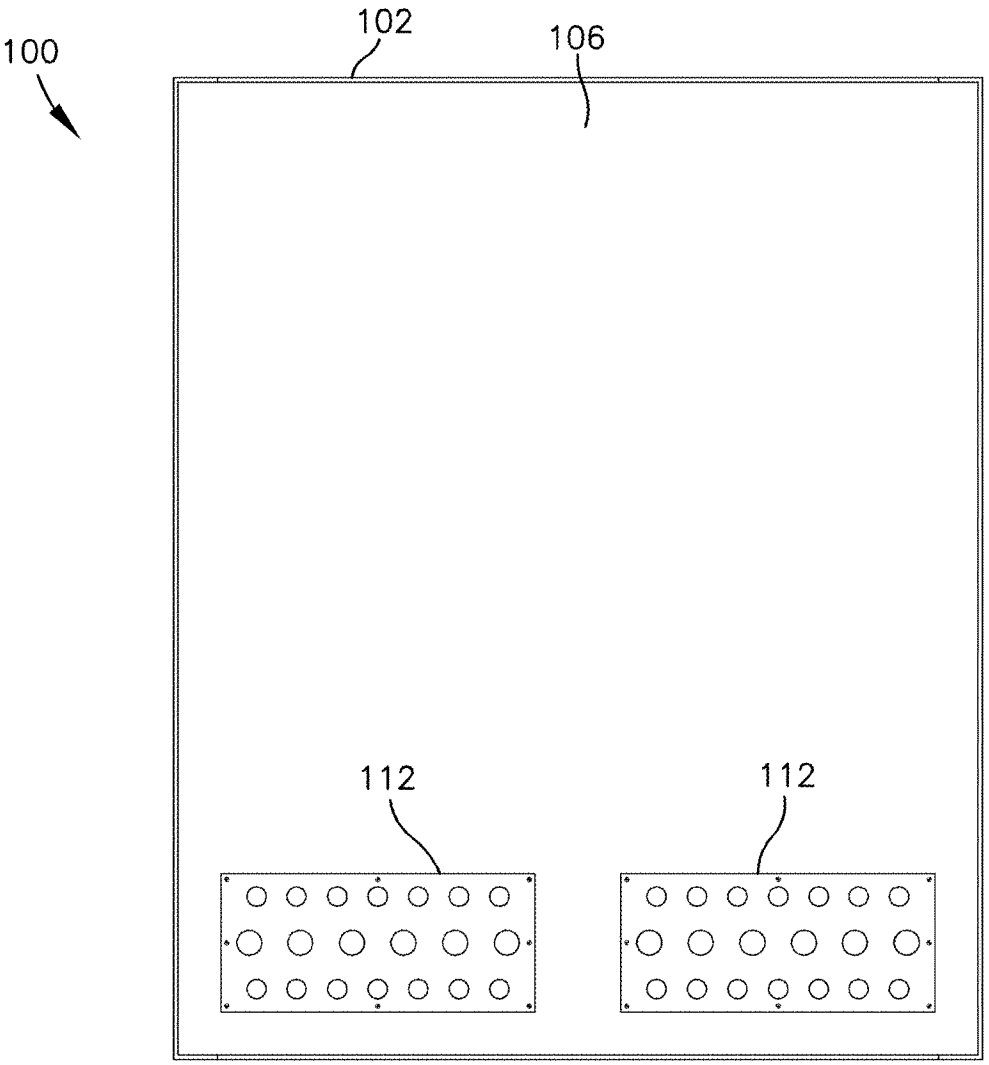
FIG. 3 is a back side elevational view of the modular sauna heater of FIG. 1.

The subject matter of select exemplary embodiments is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" or "substantially" as used herein denote deviations from the exact value by +/−0%, preferably by +/−5% and/or deviations in the form of changes that are insignificant to the function.

Exemplary embodiments are described herein with respect to the drawings in which reference numerals are employed to identify particular components or features. Similar elements in the various embodiments depicted are provided with reference numerals having matching second and third digits but with differing first digits, e.g. element 10 is similar to elements 110, 210, etc. Such is provided to avoid redundant description of similar features of the elements but is not intended to indicate the features or elements are necessarily the same.

Figure 16:
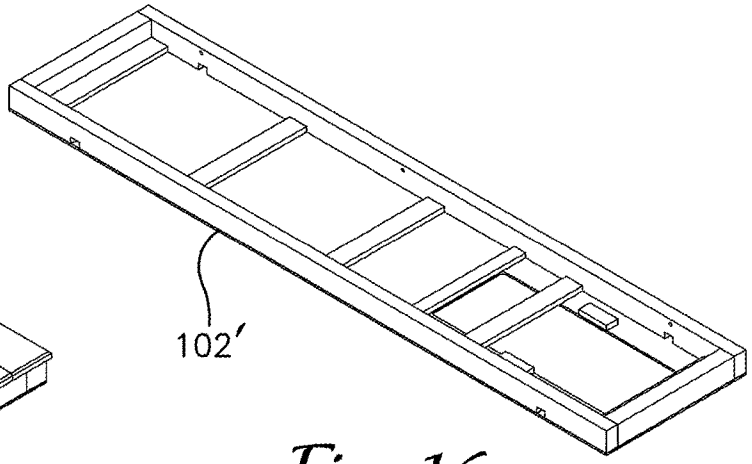
FIG. 16 is a perspective view of a housing of the modular sauna heater of FIG. 15.
Figure 15:
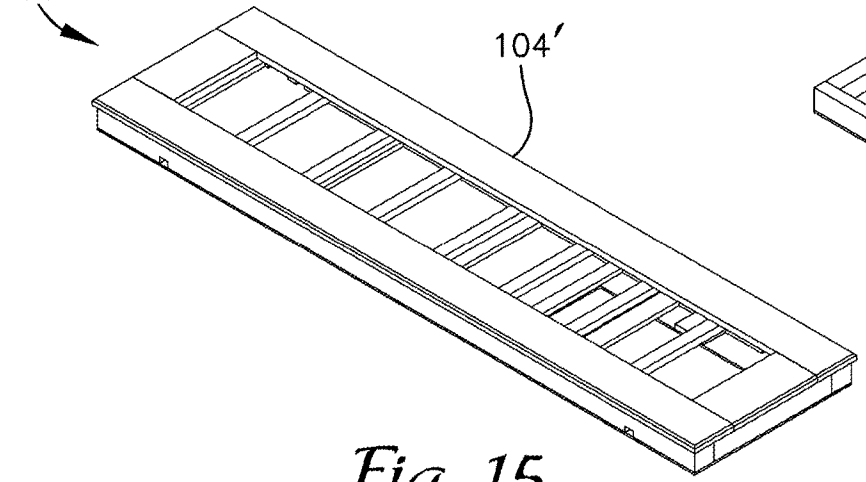
FIG. 15 is a perspective view of another modular sauna heater depicted without a heating element disposed therein in accordance with an exemplary embodiment.
Figure 18:
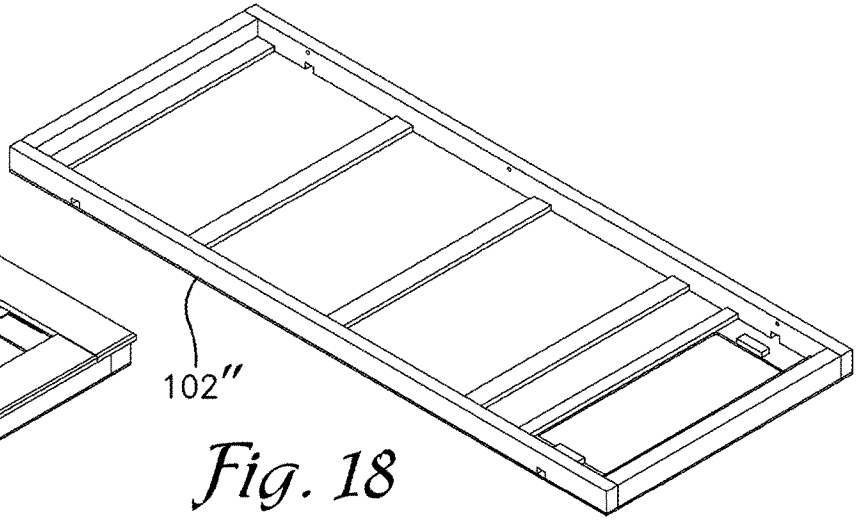
FIG. 18 is a perspective view of a housing of the modular sauna heater of FIG. 17.
Figure 17:
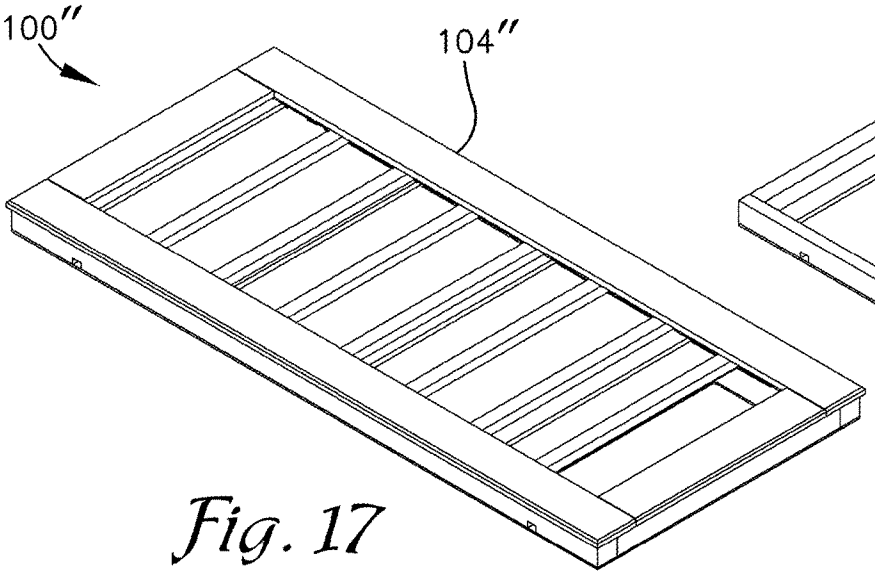
FIG. 17 is a perspective view of a third modular sauna heater depicted without a heating element disposed therein in accordance with an exemplary embodiment.
Figure 19:
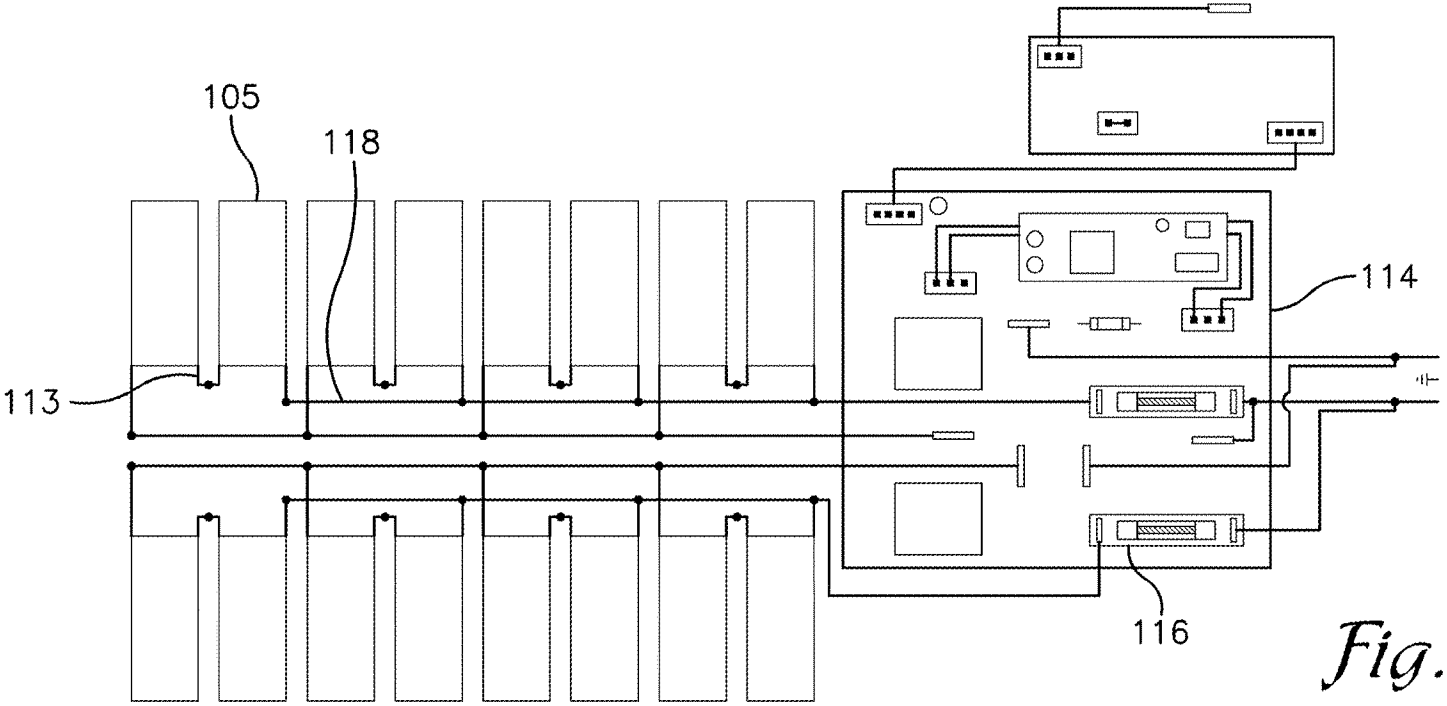
FIG. 19 is a schematic diagram of an electrical system of a sauna constructed using a plurality of modular sauna heaters depicted in accordance with an exemplary embodiment.
Figure 20:
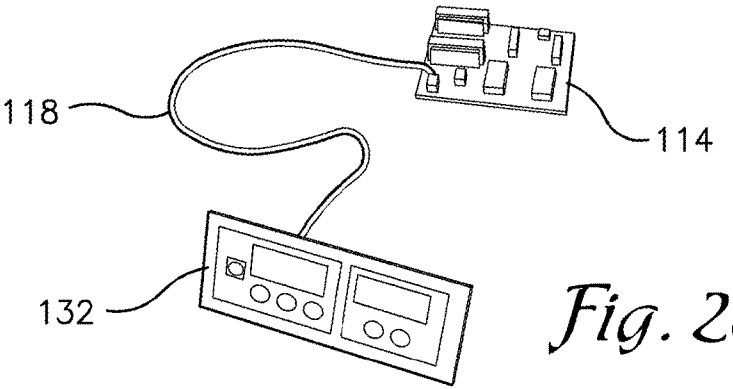
FIG. 20 is an illustrative view of a control panel and circuitry configure for use with one or more modular sauna heaters in accordance with an exemplary embodiment.
Figure 21:
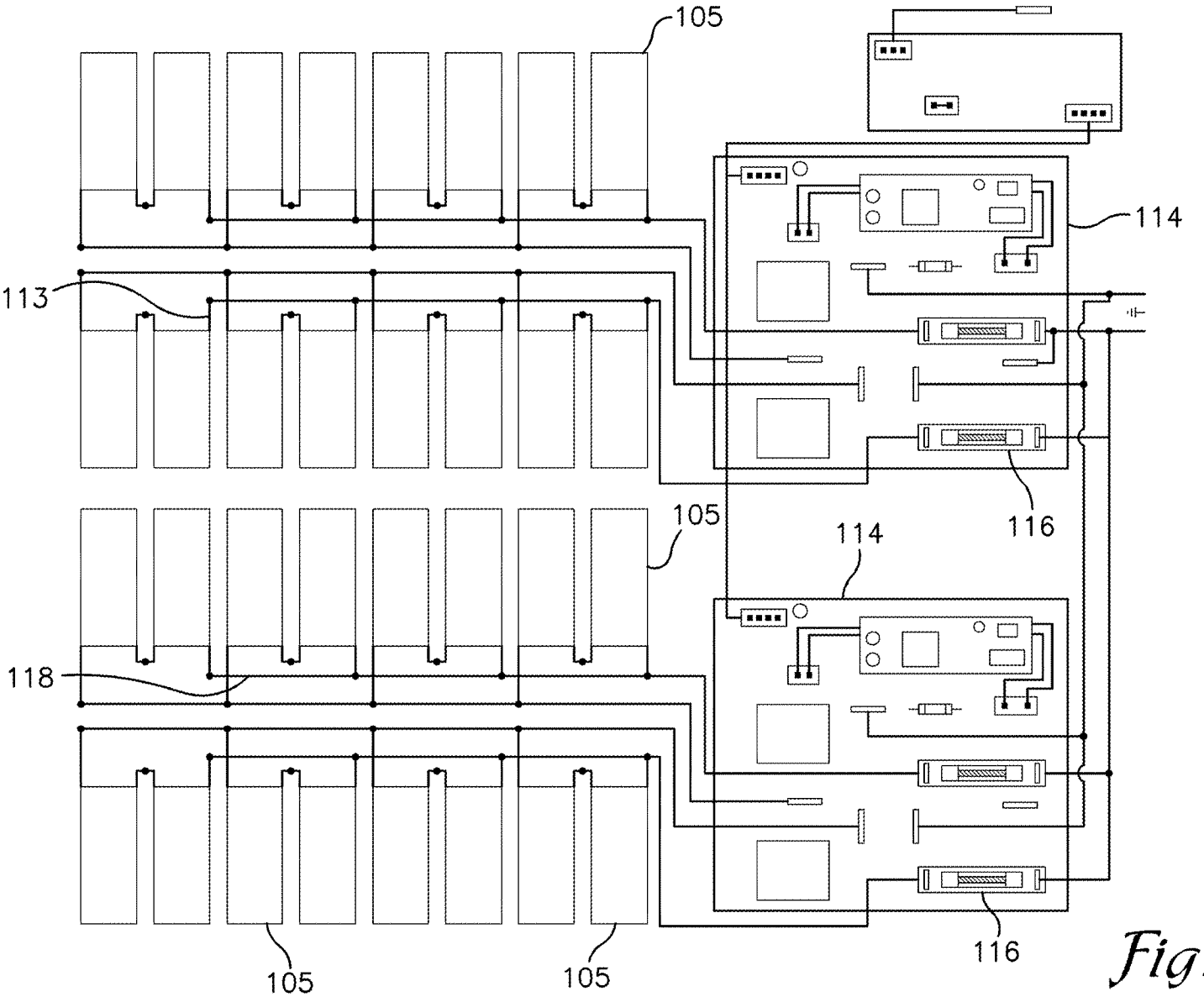
FIG. 21 is a schematic diagram of an electrical system of a sauna constructed using two banks of modular sauna heaters depicted in accordance with an exemplary embodiment.

With initial reference to FIGS. 1-21, a modular infrared (IR) heater 100 is described in accordance with an exemplary embodiment. The heater 100 includes a housing 102, a trim piece 104, and one or more heating elements 105 disposed therein. The heater 100 may be configured with a variety of dimensions and/or shapes to aid various sauna configurations, heating element configurations, and design requirements, as depicted in FIGS. 1-10, 15-16, and 17-18. For example, the heater 100 might be configured to support two, side-by-side rows of heating elements 105 (FIGS. 1-10). Or the heater 100 might be configured to support a single heating element 105 or single row of heating elements 105, like the heater 100' in FIGS. 15-16 or the heater 100" in FIGS. 17-18, among other configurations.

The heating elements 105 preferably comprise a planar infrared heating element, such as for example and not limitation, a polyimide, carbon, or ceramic sheet, but may also include one or more LED arrays or halogen bulbs, among other available heating element configurations. The heating element 105 is configured to emit infrared radiation in one or more of the near-, mid-, and far-infrared spectrums.

The boundaries defining the near-, mid-, and far-infrared ranges are not precisely defined in the scientific community. Generally, near-infrared ranges from about 750-1500 nanometers (nm), mid-infrared ranges from about 1500-7000 nm, and the far-infrared range is greater than about 7000 nm up to about 1 millimeter. In some embodiments, the near infrared range is defined to include all or at least a portion of the spectrum of visible light, especially the portion including red light, and thus includes wavelengths from about 400 nm to about 1500 nm or from about 480 nm to about 960 nm or from about 580 nm to about 960 nm.

Returning now to FIGS. 9-12, the housing 102 includes a planar back wall 106 with a perimeter wall 108 disposed about its perimeter and extending forwardly therefrom to form a generally hollow enclosure with an open front face 109. One or more ribs 110 may be provided on the housing 102 to extend across the length, width, and/or other dimension thereof. The ribs 110 may aid to stiffen or reinforce the housing 102 and/or to provide mounting locations for the heating elements 105 therein. The ribs 110 may be raised or protrude from the back wall 106 and may aid to space the heating elements 105 away from the back wall 106 to enable airflow therebetween and/or avoid excessive heating of the back wall 106. The ribs 110 may be integrally formed with the back wall 106 or may be coupled thereto via fasteners, adhesives, welding, mechanical engagements or the like. An insulative layer 111 may also be disposed between the back wall 106 and the heating elements 105 to resist heating of the back wall 106. The insulative layer 111 may comprise a reflective material, such as a metal foil, that reflects heat away from the back wall 106 or a non-thermally transmissive material such as an insulative foam, fabric, or the like or a combination thereof.

The back wall 106 may include one or more knock-out panels 112, diaphragm panels, apertures or other openings that enable passage of a cable or a pigtail 113 or other electrical and/or communication wires and cables through the back wall 106. The pigtail 113 (shown schematically in FIGS. 19 and 21) comprises one or more wires or other conductors that are in electrical communication with heating elements 105 in the heater 100 as well as thermocouples, sensors, lighting elements, controllers, or the like disposed in the housing 102. The pigtail 113 also preferably includes a coupler 115 at a distal end thereof that is configured to couple to a mating coupler of a controller 114, a bus 116, or to an extension cable 118 that couples to the controller 114 and/or the bus 116. The coupler may take any desired form including available or proprietary configurations. In one embodiment, the heater, pigtail, and controller are configured to provide plug-and-play functionality such that additional connections and/or configuration steps are not required of a user or installer before operation of the heater.

The perimeter wall 108 extends forwardly from and along the perimeter edges of the back wall 106 to provide the housing 102 with an open-faced, cuboidal form. In one embodiment, the perimeter wall 108 preferably extends generally orthogonally from the plane of the back wall 106. It is understood that other forms may be used without departing from the scope of exemplary embodiments described herein. The perimeter wall 108 may include a mounting flange 120 at a distal end thereof that extends generally inwardly and parallel to the back wall 106 and that provides a mounting location for the trim piece 104. The mounting flange 120 may include features 121 configured to aid coupling with the trim piece 104, such as, for example and not limitation, threaded bores, magnetic components, latches, hooks, and the like.

In some embodiments, the perimeter wall 108 is configured to enable passage of the pigtail 113 therethrough. One or more knockouts or existing apertures may be provided to allow the pigtail 113 to be routed through the perimeter wall 108 or a socket or similar connector may be installed in the perimeter wall 108 (or in the back wall 106) to enable coupling with the extension cable 118 or similar component.

Figure 11:
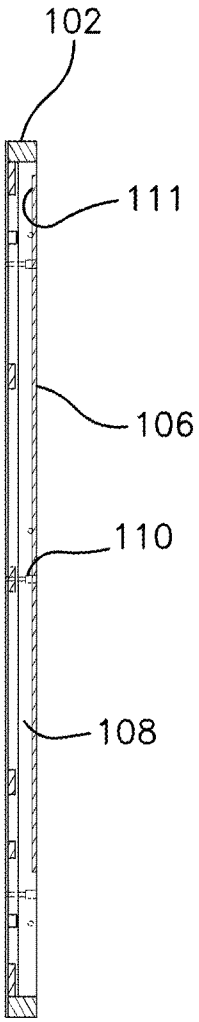
FIG. 11 is a cross-sectional view of the housing of FIG. 10 taken along the line 11-11.
Figure 14:
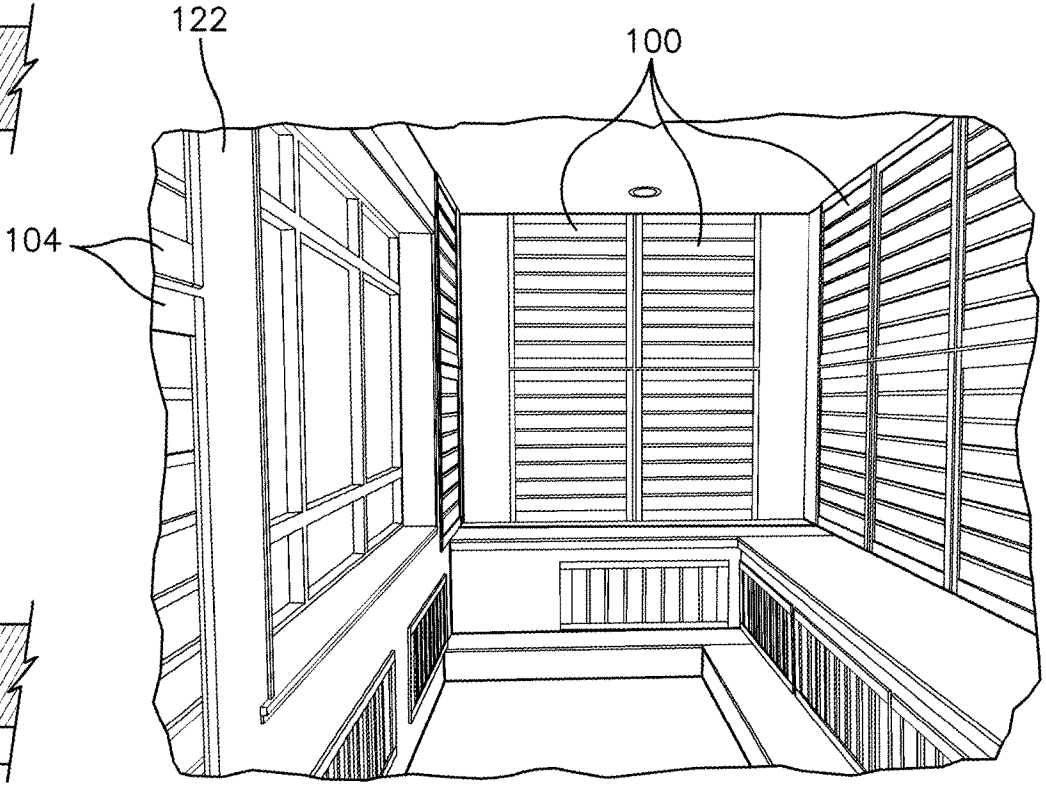
FIG. 14 is an illustrative view of a sauna constructed using modular sauna heaters in accordance with exemplary embodiments.
Figure 13A:
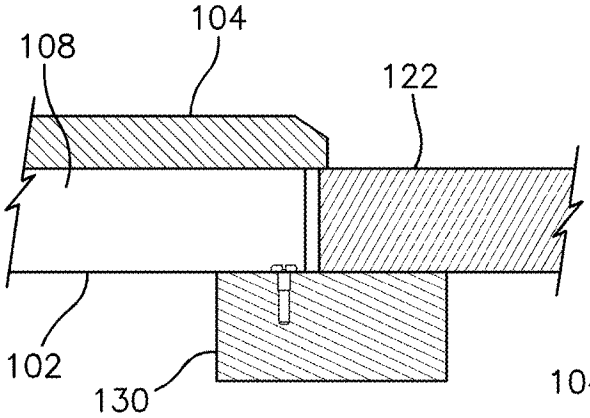
FIG. 13*a* is a schematic end view of a modular sauna heater and a wall cladding mounted to a stud wall depicted in accordance with an exemplary embodiment.
Figure 13B:
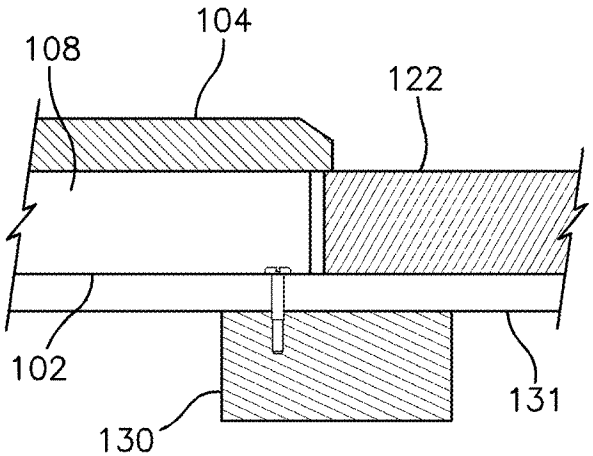
FIG. 13*b* is a schematic end view of a modular sauna heater and a wall cladding mounted to a drywall-covered wall depicted in accordance with an exemplary embodiment.

As depicted in FIGS. 11, 13*a*, and 13*b*, the height of the perimeter wall 108 is configured to provide sufficient space or depth between the back wall 106 and the mounting flange 120 for mounting the heating elements 105 within the housing 102. The heating elements 105 are preferably coupled to one or more of the ribs 110 which space the heating elements 105 away from the back wall 106 and align a front face of the heating elements 105 with the mounting flange 120 or just interior to the housing 102 beneath a plane formed by the mounting flanges 120. The height of the perimeter wall 108 is also dimensioned to be substantially equal to or just greater than a thickness of a wall cladding 122 to be applied to a wall surface around the heater 100.

Figure 6:
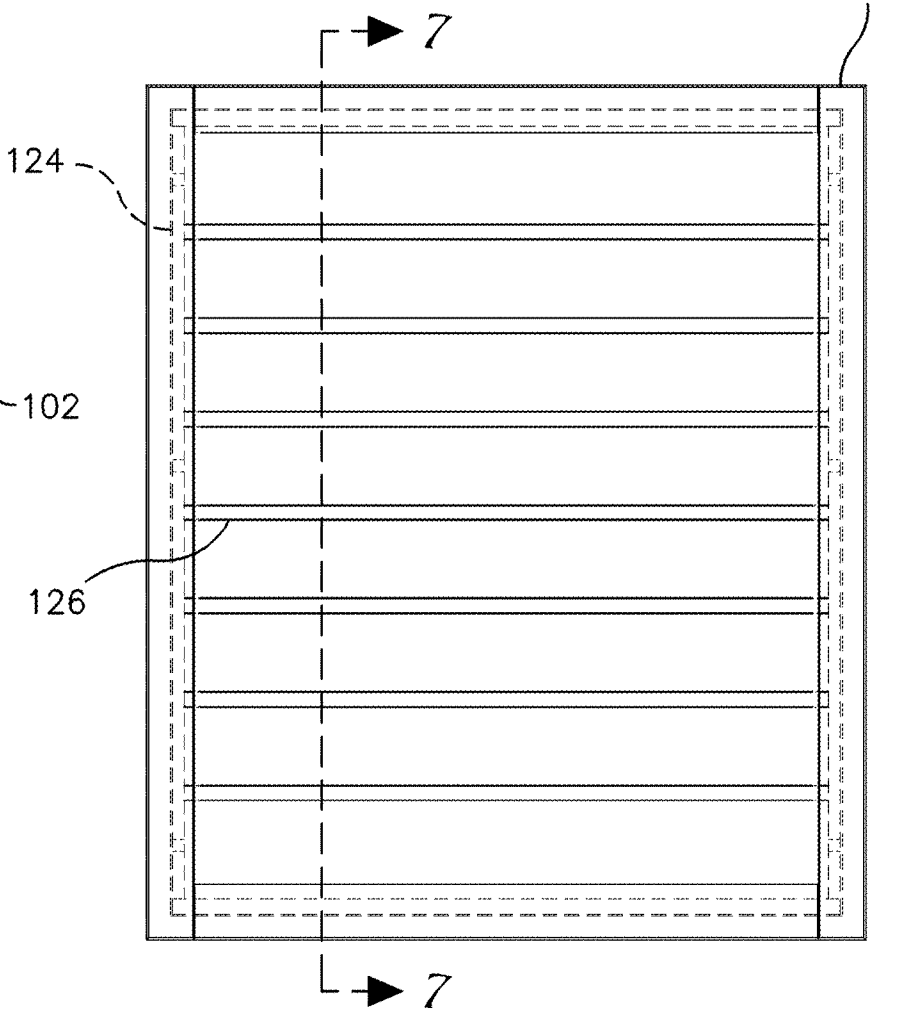
FIG. 6 is a front elevational view of a trim panel of the modular sauna heater of FIG. 1 depicted in accordance with an exemplary embodiment.
Figure 5:
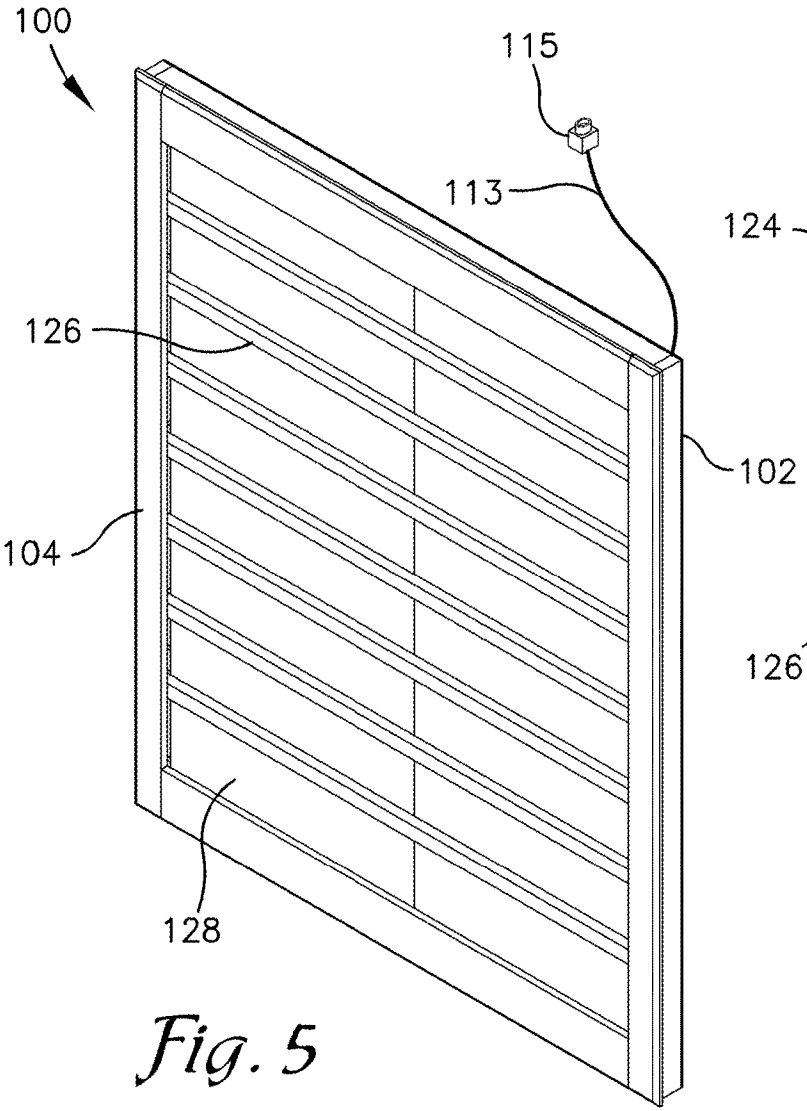
FIG. 5 is a front perspective view of the modular sauna heater of FIG. 1 depicted in accordance with an exemplary embodiment.
Figure 8:
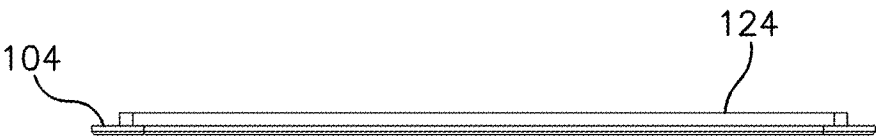
FIG. 8 is a top end elevational view of the trim panel of FIG. 6.
Figure 7:
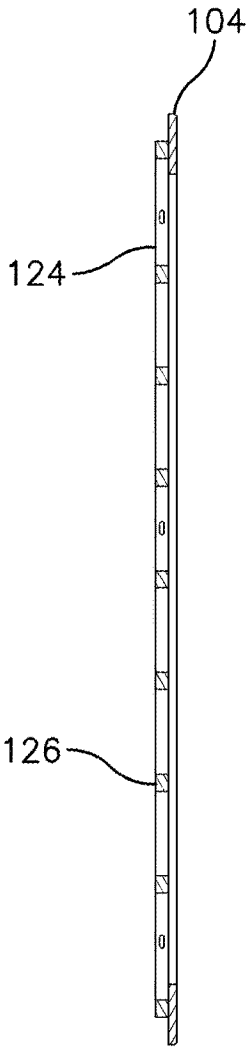
FIG. 7 is a cross-sectional view of the trim panel of FIG. 6 taken along the line 7-7.
Figure 10:
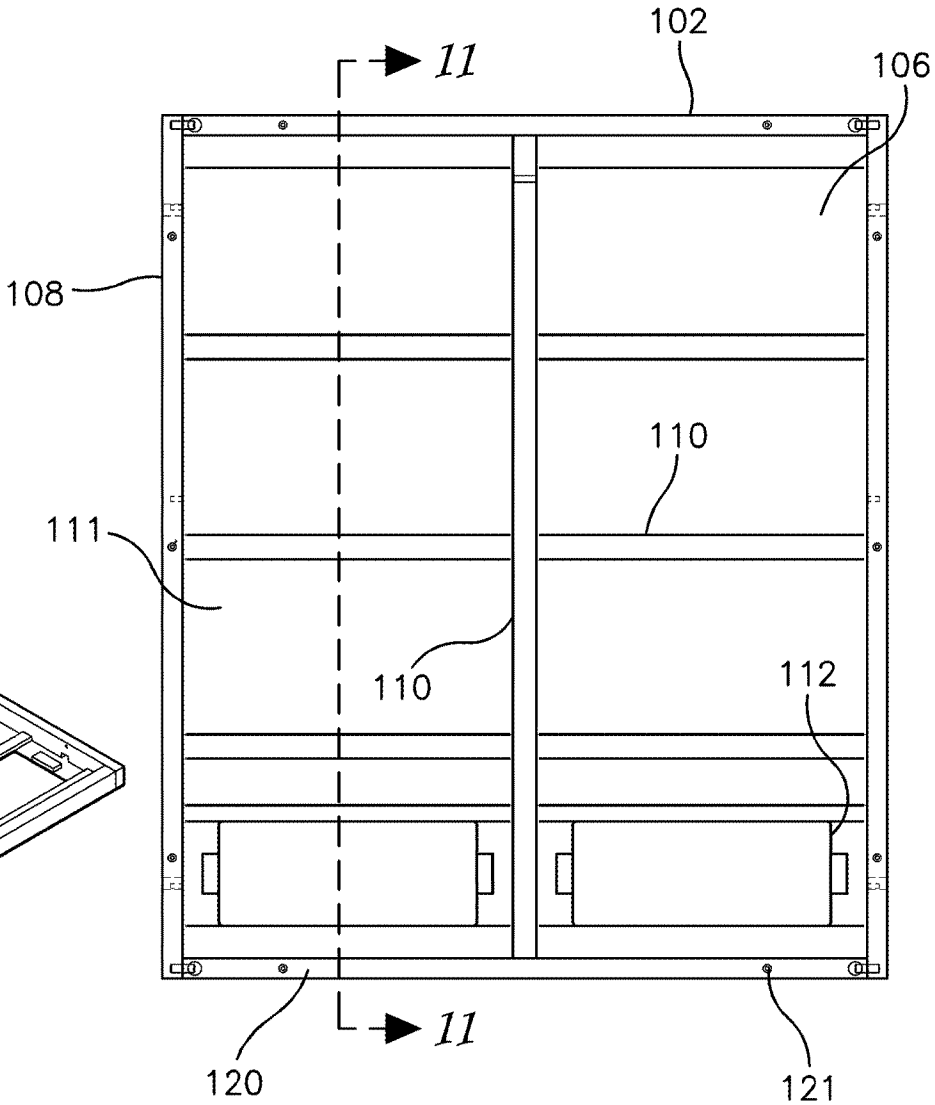
FIG. 10 is a front elevational view of the housing of FIG. 9.
Figure 9:
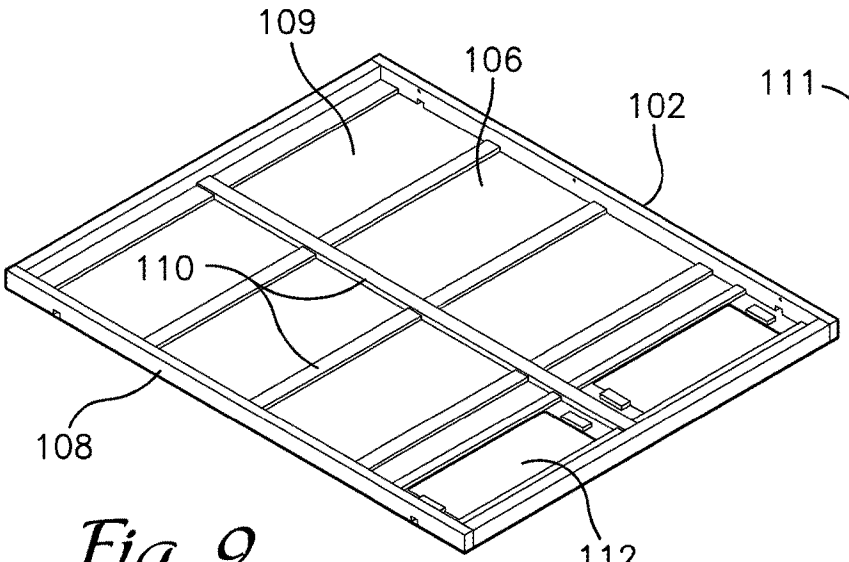
FIG. 9 is a perspective view of a housing of the modular sauna heater of FIG. 1 depicted in accordance with an exemplary embodiment.
Figure 12:
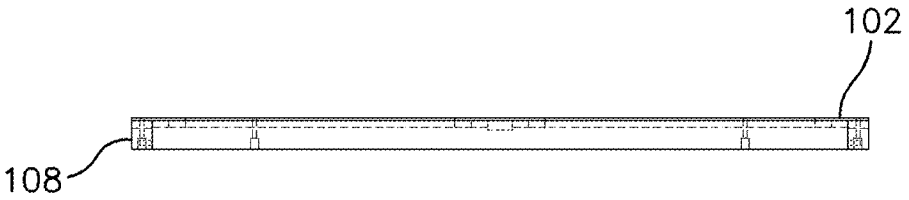
FIG. 12 is a top end elevational view of the housing of FIG. 9.

As shown in FIGS. 6-8, the trim piece 104 comprises a generally planar frame assembly configured to outline a front face of the housing 102 and to overlie and couple to the mounting flange 120. The trim piece 104 extends inwardly over the front face of the housing 102 into alignment with or just beyond an inwardly facing edge of the mounting flange 120 and extends outwardly beyond the perimeter wall 108 to overlie and obscure the distal edge or distal portion of the perimeter wall 108 from view. An inwardly facing edge of the trim piece 104 may provide an engagement flange 124 that extends toward and at least partially into an interior of the housing 102 to engage the inwardly facing edge of the mounting flange 120. Engagement between the mounting flange 120 and the engagement flange 124 thus operates to position and maintain the position of the trim piece 104 relative to the housing 102.

The trim piece 104 may include one or more cross-members 126 extending across its length and/or width. The cross-members 126 may provide stiffness to the trim piece 104 and may aid to resist or prevent contact between a user and the heating elements 105 disposed within the housing 102. The cross-members 126 might also obscure joints or spaces between separate heating elements 105 disposed within the heater 100.

A protective and/or aesthetic fabric 128 may be provided on a backside of the trim piece 104 to obscure a user's view of the contents of the housing 102. The fabric 128 may alternatively be coupled to the housing 102 to extend between the mounting flanges 120 or may be provided on a front face of the heating elements 105. The fabric 128 preferably comprises a material that is substantially permeable or transparent to infrared radiation, and, in one embodiment, may comprise a fabric formed at least in part from carbonized bamboo filaments. In another embodiment, the fabric 128 comprises a perforated plastic, metallic, ceramic, composite, wood, or similar sheet material which may be at least semi-rigid to resist deflection into contact with the underlying heating element 105.

With continued reference to FIGS. 1-21, a method for constructing a sauna using the modular infrared heaters 100 is described in accordance with an exemplary embodiment. Initially, a structure forming the sauna is constructed or a preexisting structure is chosen. The structure may provide a stud wall in which a plurality of vertically aligned support studs 130 are provided at a predetermined spacing. Preferably, the spacing of the studs 130 compliments dimensions of the heaters 100 such that mounting features provided on the heaters 100 align with the studs 130. For example, the studs 130 may be spaced such that each heater 100 spans between a pair of studs 130 and/or overlaps the studs 130, e.g. overlaps about half of a width of the stud 130. In one embodiment, the heater 100 is disposed and mounted at least partially recessed into a space between a pair of studs 130 such that side faces formed by the perimeter wall 108 face or abut side faces of the studs 130. In another embodiment, one or more brackets or other support members are provided to support the heater 100 at a location between the studs 130.

In some embodiments, the studs 130 are covered with a drywall, gypsum board, or other common wall sheathing 131 and the heaters 100 may be abutted against the wall sheathing 131, as depicted in FIG. 13*b*. In such embodiments, the heaters 100 may be coupled to the studs 130 via fasteners inserted through the wall sheathing 131 and into the underlying stud 130.

The structure includes any desired insulation, vapor barriers, or the like. Components, like seating, storage, lighting, or the like may be added to the structure and may provide additional mounting locations for the heaters 100. The structure is also prepared with any needed plumbing and electrical wiring, including the extension cables 118 which may be installed within the walls of the structure or along a surface of the walls. The controller 114 may be mounted in the structure and coupled with the extension cables 118 as well as with a local power grid. One or more sensors may also be installed in the structure to provide data and/or signals to the controller 114 to aid operation of the sauna. The controller may include a display unit 132 that is mounted within the structure and that enables a user to control one or more functions and operations of the sauna and/or displays one or more characteristics of the sauna. For example, the display 132 may include an LCD display that indicates a temperature in the sauna and/or a treatment time, among other characteristics or data elements associated with the operation of the sauna. In another embodiment, the display 132 and/or the controller 114 may comprise a computing device, such as a tablet computer, mobile device, or the like.

The controller 114 may further be communicably and/or operably coupled with a communications network, such as the internet, a wide area network, or a local area network, among others, and thus with one or more disparate controllers, data sources, and sensors, among other components. Such other controllers and components may be configured to remotely control or instruct operations of the controller 114 and thus the heaters 100 and any other components coupled thereto. For example, a user might start a preheat cycle for the sauna using a network connected device like a mobile smart phone from a location that is disparate from that of the sauna. Or the user might employ operational cycles or a training schedule that is provided to the controller 114 via a communications network from a disparate computing device, among a variety of other features. Operation of the sauna might also be tracked remotely for maintenance, hardware/software updates, billing, and the like. Further detail of such a distributed control and/or data network is provided in U.S. Patent Application Publication No. 2020/0069516 to Zack, filed Aug. 23, 2019, the disclosure of which is incorporated herein in its entirety by reference.

One or more modular infrared heaters 100 of equal or differing dimensions are selected and mounted to the walls of the structure in a desired arrangement. The heaters 100 may be coupled directly to the studs 130 via fasteners installed therebetween. In embodiments in which a wall sheathing 131 is present on the stud wall, the heaters 100 may be disposed on the sheathing 131 and coupled to the studs 130 or other support members via fasteners that extend through the sheathing 131 and into the studs 130. In some embodiments, a vapor barrier, insulation, or other materials might be disposed on the wall structure, coupled directly to the studs 130 or to the wall sheathing 131, prior to installation of the heaters 100 thereon. The heaters 100 may be installed on the wall structure in direct contact with such materials.

In one embodiment, the heaters 100 are configured to mount directly on the wall structure without need for clearance or open space or additional insulation therebetween. The heating elements 105 are configured to direct very little infrared radiation or heat toward the back wall 106 of the housing 102 and thus reduce or eliminate risks or concerns of overheating the underlying wall structure. Additionally, any insulative layers 111 applied to the back wall 106 and/or spacing between the heating elements 105 and the back wall 106 provided by the ribs 110 further decreases any heating of the back wall 106 and thus the underlying wall structure.

The heaters 100 are preferably spaced apart from one another at least a distance sufficient to enable installation of their respective trim pieces 104 without the trim pieces 104 overlapping. Preferably, the trim pieces 104 of adjacent heaters 100 abut along one edge or are spaced sufficiently apart to enable installation of the wall cladding 122 between their adjacent perimeter walls 108. In one embodiment, the trim piece 104 is configured to couple to more than one heater 100 mounted side-by-side.

The pigtails 113 of each of the heaters 100 are routed through their back walls 106 or perimeter walls 108 and coupled to the controller 114, the bus 116, or to one or more extension cables 118. The pigtails 113 and/or the extension cables 118 may be routed within the interior of the stud wall, behind any wall sheathing, and/or behind wall cladding 122 disposed on the walls as desired.

The wall cladding 122 is disposed on the walls, ceilings, and other desired surfaces of the structure. The wall cladding 122 has a thickness sized to compliment the height of the perimeter walls 108 such that the wall cladding 122 fits between the surface of the stud 130 or wall sheathing 131 and a backside surface of the trim piece 104. In one embodiment, the housing 102 may be at least partially recessed into the wall of the structure such that the wall sheathing 131 may be employed in place of the wall cladding 122. As such, edges of the wall cladding 122 around each of the heaters 100 are obscured from view by the trim pieces 104 of each of the heaters 100.

The trim pieces 104 are preferably installed on the heaters following mounting of the heaters 100 on the structure and installation of the wall cladding 122 but may be installed at any time. The trim pieces 104 may couple to the housings 102 via one or more magnetic couplings, hanging of the trim pieces 104 on hooks or similar features on the housings 102, releasable engagement or friction-fit couplings, or by installation of fasteners between the trim pieces 104 and the housings 102, among other methods.

As such, the heaters 100 can be installed in the sauna by simple mounting and simple plug-and-play coupling with the controller. In contrast, construction of saunas using previously available components requires much more complex and painstaking steps. For example, individual heating elements must be hardwired with a control circuit, the sauna structure must be constructed in a manner that accommodates required clearances around and between the heating elements, accommodates particular mounting configurations of the heating elements, and skilled craftsman must be employed to apply wall cladding and construct framing around each of the heating elements. Further, care must be taken to avoid damage to the heating elements during handling and installation, because prior art heating elements are not provided with a protective enclosure.

Referring now to FIGS. 22-27, standalone modular infrared heaters 200 are described in accordance with exemplary embodiments. Like the heater 100, the heaters 200 include a housing 202 in which one or more infrared emitting heating elements 205 (not shown) are disposed. A trim piece 204 is provided that couples on or over a front face of the housing 202 and includes a fabric 228 or similar material that substantially encloses the front face of the housing 202 while also allowing passage of emitted infrared radiation therethrough. In one embodiment, the fabric 228 comprises a plate formed from a metallic, carbon, or other emissive material.

Figure 23:
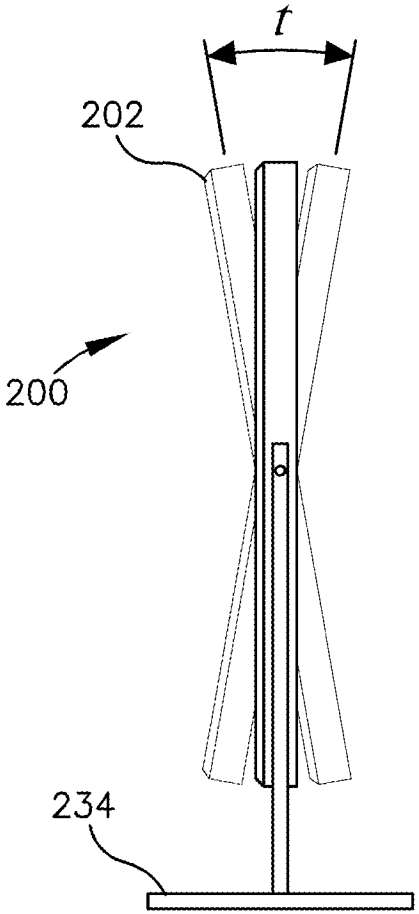
FIGS. 22-23 are illustrative views of a free-standing modular infrared heater depicted in accordance with an exemplary embodiment.
Figure 22:
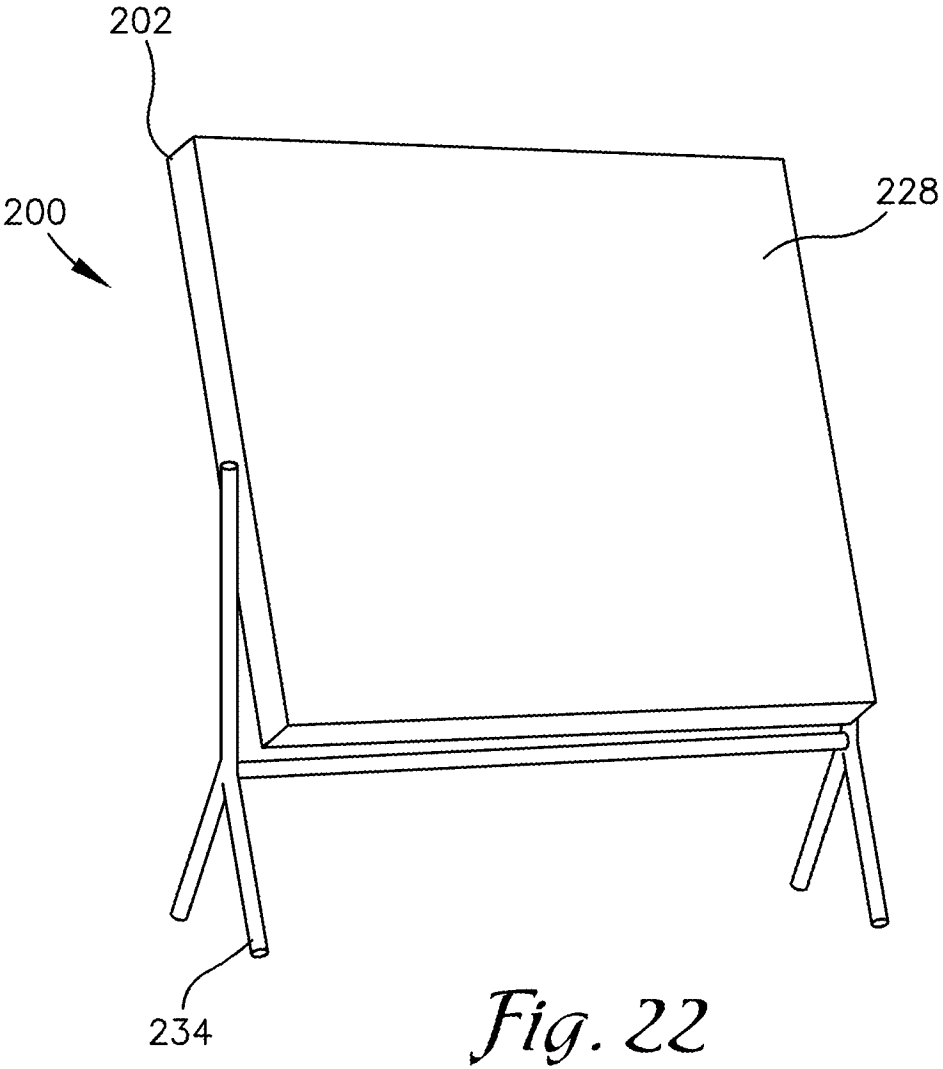

The heaters 200 are configured to enable simple transformation of an existing room or location into a sauna-style enclosure and/or to provide infrared heating to an existing room or location. As such, the heaters 200 may be provided with a leg or a base assembly 234 to provide a free-standing configuration, as depicted in FIGS. 22-23. The base assembly 234 may enable tilting or swiveling of the heater 200 to effectively aim the infrared radiation output therefrom.

The heaters 200 can also be configured for wall or ceiling mounting as depicted in FIGS. 24-27. A mounting arm 236 may be provided on the housing 202 extending from a rear side thereof which useable to couple the heater 200 to a wall or ceiling surface. Alternatively, the housing 202 may be configured for direct mounting to a wall or ceiling in a manner similar to that described above for the housing 102. The mounting arm 236 may be provided in a variety of configurations to aid coupling and/or supporting the heater 200 on the wall/ceiling. Although only a single mounting arm is depicted in the figures, a plurality of mounting arms may be provided.

The heaters 200 are preferably configured with an internal controller configured to control operation of heating elements 205, sensors, lighting element, or the like that may be disposed in the housing 202. A pigtail 213 (not shown) is provided extending from the housing 202 which may be direct wired or plugged into an existing power supply in the room or location. Alternatively, the heaters 200 may be coupled with an electrical communications and control circuitry like that discussed above for the heaters 100 and operated in a similar manner.

A control panel or display 232 (not shown) may be provided on the housing 202 or within a portion of the trim piece 204 to enable a user to control operation of the heater 200. The controller 214 may also be configured for wireless communication and control by a wireless device, such as a mobile device executing an application or other computing device.

As described previously, the heating elements 105, 205 of the heaters 100, 200 respectively preferably comprise planar heating elements. Such heating elements 105, 205 may have a generally continuous or monolithic configuration in which substantially the full heating surface of the heater 105/205 produces infrared radiation within a single wavelength range, e.g. near-, mid-, or far-infrared range. The heating elements 105/205 may alternatively be configured with one or more portions configured to produce or emit infrared radiation in different wavelength ranges.

Figures 28, 29, 30:
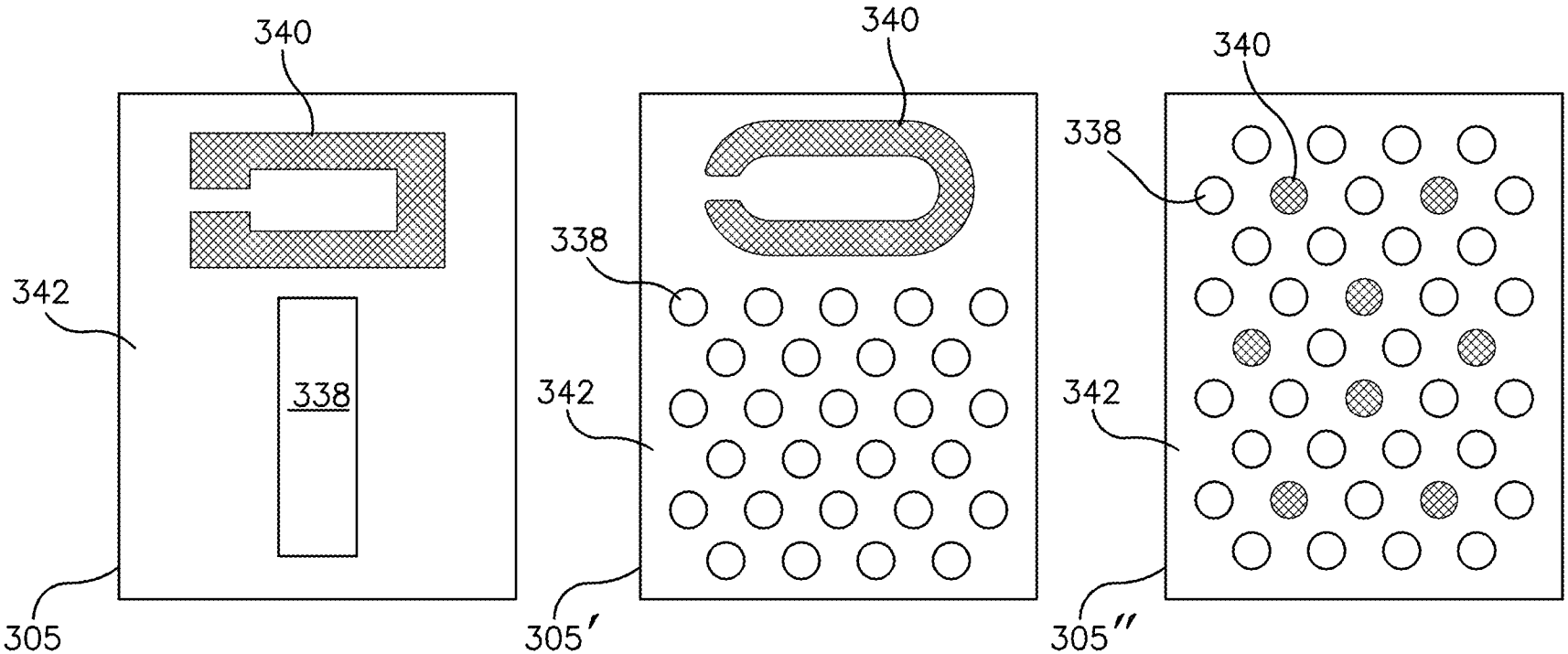
FIGS. 28-30 are schematic views of infrared heating element configurations usable in modular infrared heaters in accordance with exemplary embodiments.

FIGS. 28-30 depict three different configurations of multi-wavelength-range heating elements 305, 305', 305" that can emit infrared radiation in multiple different wavelength ranges. Each of the heating elements 305, 305', 305" are configured to emit infrared radiation in near-, mid-, and far-infrared wavelength ranges, however such is not intended to limit embodiments to any particular number or ranges of radiation that might be emitted thereby.

Each of the heating elements 305, 305', 305" includes a near-infrared emitting portion 338, a mid-infrared emitting portion 340, and far-infrared emitting portion 342. Each of these portions 338, 340, 342 may be a separate heating element component or they may be integrated into a single unit. Further, each of the portions may utilize the same or different heating or infrared generating technologies, i.e. the far-infrared portions 342 may use a polyimide planar heating element while the near-infrared portions 338 may employ an array of LEDs disposed within a cutout in the planar heating element of the far-infrared portion 342. Additionally, although the portions 338, 340, 342 are depicted in particular locations within the heating element 305, 305', 305" their locations may be interchangeable.

Each of the portions 338, 340, 342 may be controlled together or independently by the controller to enable a user to selectively choose which of the portions 338, 340, 342 emit infrared radiation at any given time. In one embodiment, the portions 338, 340, 342 are tuneable by the controller to adjust the wavelengths of infrared radiation emitted thereby, such as by adjusting a current or voltage applied to the particular portion 338, 340, 342. For example, a current applied to the mid-infrared portion 340 might be adjusted by the controller to cause the mid-infrared portion to emit infrared radiation in the far-infrared wavelength range. In one embodiment, one or more of the portions 338, 340, 342 may be configured to emit radiation in a non-infrared wavelength, such as in wavelength in the visible light or ultraviolet light spectrums.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. A modular sauna heater comprising:

a housing having a planar back wall with a perimeter wall extending orthogonally from a perimeter thereof to form a hollow enclosure with an open front face, the housing being mountable on a wall of a structure with an exterior surface of the back wall in abutment with the wall of the structure;

a trim piece configured to couple to and obscure from view a distal portion of the perimeter wall;

a heating element configured to emit infrared radiation in at least one of a near-, mid-, or far-infrared spectrum, the heating element disposed within the hollow enclosure of the housing to emit infrared radiation through the open front face, wherein a front face of the heating element is aligned just interior to the housing; and means for communicably coupling the heating element with a controller.

2. The modular sauna heater of claim 1, wherein the housing is sized to extend between support members of a wall structure and to couple to the support members via one or more fasteners.

3. The modular sauna heater of claim 1, wherein the housing includes one or more ribs disposed along the back wall, the ribs extending into the hollow enclosure, and wherein the heating element is spaced apart from the back wall by one or more of the ribs.

4. The modular sauna heater of claim 1, further comprising an insulative layer disposed on the back wall of the housing.

5. The modular sauna heater of claim 1, further comprising:

a wall cladding disposable on the wall of the structure to surround the housing in one of abutment or close proximity to the perimeter wall of the housing when mounted on the wall of the structure, the wall cladding having a thickness configured to fit between the wall of the structure and a backside of the trim piece when the trim piece is coupled to the housing.

6. The modular sauna heater of claim 5, wherein the wall of the structure includes a wall sheathing, and wherein the housing and the wall cladding are installed on the wall sheathing.

7. The modular sauna heater of claim 1, wherein the trim piece is removably coupled to the housing.

8. The modular sauna heater of claim 1, further comprising:

one or more cross-members coupled with the trim piece and extending across at least a portion of the open front face of the housing; and a fabric disposed between the trim piece and a front face of the heating element, the fabric obscuring a view of the heating element and being substantially transparent to infrared radiation.

9. The modular sauna heater of claim 1, wherein the heating element is a planar heating element comprised of one or more of polyimide, carbon, or ceramic materials.

10. The modular sauna heater of claim 1, wherein the heating element includes one or more LED arrays.

11. The modular sauna heater of claim 1, wherein the heating element includes one or more halogen bulbs.

12. The modular sauna heater of claim 1, further comprising:

a control unit configured to communicatively couple to and control operation of the heating element and a plurality of similarly configured heating elements via their respective means for communicably coupling the heating element with the controller.

13. A method for constructing a sauna, the method comprising:

mounting a housing of a modular sauna heater on a wall of a structure with an exterior surface of a back wall of the housing disposed in abutment with the wall of the structure, the housing including a perimeter wall extending orthogonally from a perimeter of the back wall to form a hollow enclosure with an open front face, and a heating element disposed within the hollow enclosure to emit infrared radiation through the open front face, the heating element configured to emit infrared radiation in at least one of a near-, mid-, or far-infrared spectrum;

applying a wall cladding to the wall of the structure surrounding the housing in one of abutment or close proximity to the perimeter wall of the housing, the wall cladding having a thickness configured to fit between the wall of the structure and a distal portion of the perimeter wall of the housing;

coupling a trim piece to the distal portion of the perimeter wall of the housing, the trim piece configured obscure the distal portion of the perimeter wall and an edge of the wall cladding adjacent the perimeter wall from view;

communicably coupling the heating element with a controller; and operating the heating element via the controller to provide one or more of near-, mid-, or far-infrared treatment to a user positioned within the structure.

14. The method of claim 13, wherein mounting a housing of a modular sauna heater on a wall of a structure further comprises:

aligning the housing with support members of the wall of the structure, the housing having a width that is greater than a spacing between two support members such that the housing partially overlaps each of the two support members and the back wall of the housing abuts a front face of each of the two support members; and installing fasteners between the housing and the respective support members.

15. The method of claim 13, wherein the wall of the structure comprises a plurality of support members and a wall sheathing disposed thereon, and wherein mounting a housing of a modular sauna heater on a wall of a structure further comprises:

aligning the housing with at least two of the support members of the wall of the structure, the housing having a width that is greater than a spacing between the two support members such that the housing partially overlaps each of the two support members and the back wall of the housing abuts a front face of the wall sheathing; and installing fasteners between the housing and the two support members and through the wall sheathing.

16. The method of claim 13, wherein the housing comprises a first housing, and the method further comprising:

mounting a of second housing on the wall of the structure side-by-side with the first housing, the second housing being coupled to at least one of the same support members as the first housing, and wherein the trim piece couples to both the first housing and the second housing.

17. The method of claim 13, wherein the wall of the structure is a ceiling.

18. The method of claim 13, wherein the step of communicably coupling the heating element with the controller comprises coupling a cable extending from the housing with the controller, the cable including a first coupler that is configured to mateably couple with a corresponding second coupler associated with the controller, the method further comprising:

mounting the controller in the structure; and routing the cable extending from the housing behind the wall cladding and to the controller.

19. The method of claim 18, wherein a plurality of the modular sauna heaters are mounted on the wall of the structure and the respective cable from each of the plurality of modular sauna heaters is coupled to a bus of the controller.

20. A method for constructing a sauna, the method comprising:

providing a structure that includes a plurality of walls, each comprised of a plurality of support members and a wall sheathing disposed thereon, mounting a plurality of modular sauna heaters on the walls of the structure, each of the modular sauna heaters including a housing with a back wall that is disposed in abutment with the wall sheathing, each housing including a perimeter wall extending orthogonally from a perimeter of the respective back wall to form a hollow enclosure with an open front face and a heating element disposed within the hollow enclosure to emit infrared radiation through the open front face, the heating element configured to emit infrared radiation in at least one of a near-, mid-, or far-infrared spectrum;

applying a wall cladding to the wall of the structure surrounding each of the housings, the wall cladding being placed in one of abutment or close proximity to the perimeter walls of each of the housings, the wall cladding having a thickness configured to fit between the wall of the structure and a distal portion of the perimeter wall of the housing;

coupling a respective trim piece to the distal portion of the perimeter wall of each housing, the trim piece configured obscure from view the distal portion of the perimeter wall and an edge of the wall cladding adjacent the perimeter wall;

coupling a respective cable extending from each of the housings with a controller, each cable including a first coupler that is configured to mateably couple with a corresponding second coupler associated with the controller, the cables communicably coupling the respective heating elements with the controller; and operating the heating elements via the controller to provide one or more of near-, mid-, or far-infrared treatment to a user positioned within the structure.

21. The modular sauna as in claim 1 wherein the means for communicably coupling the heating element with the controller comprises a cable extending from the housing and configured to communicably couple the heating element with a controller, the cable including a first coupler that is configured to mateably couple with a corresponding second coupler on the controller or on an extension cable disposed between the coupler and the controller.

22. The method of claim 13, wherein the step of communicably coupling the heating element with the controller comprises coupling a cable extending from the housing with the controller, the cable including a first coupler that is configured to mateably couple with a corresponding second coupler associated with the controller.

23. A modular sauna heater comprising:

a housing having a planar back wall with a perimeter wall extending from a perimeter thereof to form a hollow enclosure with an open front face, the perimeter wall having a distal portion, the perimeter wall having a mounting flange at the distal portion thereof, and the housing being mountable on a wall of a structure with an exterior surface of the back wall in abutment with the wall of the structure;

a trim piece configured to couple to the mounting flange and obscure from view the distal portion of the perimeter wall;

a heating element configured to emit infrared radiation in at least one of a near-, mid-, or far-infrared spectrum, the heating element disposed within the hollow enclosure of the housing to emit infrared radiation through the open front face of the housing, wherein a front face of the heating element is approximately aligned with the mounting flange; and means for communicably coupling the heating element with a controller.

* * * * *